US010190859B2

(12) United States Patent
Engmann et al.

(10) Patent No.: US 10,190,859 B2
(45) Date of Patent: Jan. 29, 2019

(54) LIGHTWEIGHT AMMUNITION BOX

(71) Applicant: PLASTPACK DEFENCE ApS, Ringsted (DK)

(72) Inventors: Jan Bendix Engmann, Hvidovre (DK); Jørgen Dahl, Fjenneslev (DK)

(73) Assignee: PLASTPACK DEFENCE APS, Ringsted (DK)

( * ) Notice: Subject to any disclaimer, the term of this patent is extended or adjusted under 35 U.S.C. 154(b) by 0 days.

(21) Appl. No.: 15/555,114

(22) PCT Filed: Mar. 2, 2016

(86) PCT No.: PCT/DK2016/050060
§ 371 (c)(1),
(2) Date: Sep. 1, 2017

(87) PCT Pub. No.: WO2016/138909
PCT Pub. Date: Sep. 9, 2016

(65) Prior Publication Data

US 2018/0038674 A1 Feb. 8, 2018

(30) Foreign Application Priority Data

Mar. 4, 2015 (DK) ..... 2015 00133

(51) Int. Cl.
*F42B 39/00* (2006.01)
*F42B 39/26* (2006.01)
*B65D 43/16* (2006.01)

(52) U.S. Cl.
CPC ..... *F42B 39/26* (2013.01); *B65D 43/166* (2013.01); *B65D 43/167* (2013.01); *F42B 39/00* (2013.01)

(58) Field of Classification Search
CPC ..... F42B 39/00; F42B 39/02; F42B 39/30; F42B 39/26; A45C 13/36; B65D 1/42; B65D 1/46; B65D 43/166; B65D 43/167
(Continued)

(56) References Cited

U.S. PATENT DOCUMENTS 3,593,873 A 7/1971 Vonk
4,666,034 A * 5/1987 Johnson ..... F42B 39/00 206/3

(Continued)

FOREIGN PATENT DOCUMENTS

EP 0047862 A1 3/1982
EP 3039376 B1 10/2017

(Continued)

OTHER PUBLICATIONS

International Preliminary Report on Patentability PCT/DK2016/050060, dated Sep. 5, 2017, 1 page.

(Continued)

*Primary Examiner* — J. Gregory Pickett
*Assistant Examiner* — Rafael Ortiz
(74) *Attorney, Agent, or Firm* — Zeigler IP Law Group, LLC

(57) ABSTRACT

An ammunition box with a rectangular molded thermoplastic material box body defining a rectangular storage space for ammunition. The box body opens to one side that can be closed with a flat rectangular molded thermoplastic material lid. The box body is provided with integrally molded hollow collapsible projections at its corners for preventing damage from impact to the ammunition box. The lid can be provided with corresponding integrally molded hollow collapsible projections that preferably form an extension of the integrated molded hollow collapsible projections of the box body when the lid is in the closed position.

18 Claims, 18 Drawing Sheets

(58) Field of Classification Search
USPC .... 206/3, 317, 703, 557, 562, 1.5; 220/4.21, 220/4.23, 4.06, 4.07
See application file for complete search history.

(56) References Cited

U.S. PATENT DOCUMENTS

| | | | | |
|---|---|---|---|---|
| 5,381,920 | A * | 1/1995 | Lin | B25H 3/02 16/261 |
| 2003/0038142 | A1* | 2/2003 | Gee | A45C 13/005 220/835 |
| 2004/0055922 | A1 | 3/2004 | Ordonez | |
| 2010/0077813 | A1 | 4/2010 | Zhang et al. | |
| 2012/0181215 | A1* | 7/2012 | Brooks | H01L 21/67369 206/711 |
| 2015/0013108 | A1* | 1/2015 | Fraser | E05D 11/06 16/381 |

FOREIGN PATENT DOCUMENTS

| | | | |
|---|---|---|---|
| GB | 722347 | A | 1/1955 |
| JP | 2011040324 | A * | 2/2011 |
| KR | 101425670 | B1 | 8/2014 |
| KR | 20140111838 | A | 9/2014 |
| WO | 9318975 | A1 | 9/1993 |
| WO | 0176960 | A1 | 10/2001 |
| WO | 2007070029 | A1 | 6/2007 |
| WO | 2011090766 | A1 | 7/2011 |

OTHER PUBLICATIONS

Written Opinion of International Searching Authority; PCT/DK2016/050060, dated May 23, 2016, 5 pages.
International Search Report, Application No. PCT/DK2016/050060, dated May 23, 2016, 3 pages.
Extended European Search Report, Application No. 18154679.7, dated Jun. 4, 2018, 10 pages.
Extended European Search Report, Application No. 18154682.1, dated Jun. 4, 2018, 7 pages.
Extended European Search Report, Application No. 16758500.9, dated Aug. 16, 2018, 9 pages.

* cited by examiner

LIGHTWEIGHT AMMUNITION BOX

TECHNICAL FIELD

The aspects of the present disclosure relate generally to ammunition boxes and in particular to lightweight ammunition boxes.

BACKGROUND

An ammunition box or cartouche box is a container designed for safe transport and storage of ammunition. Known ammunition boxes are typically made of steel plates and labelled with caliber, quantity, and manufacturing date or lot number. A rubber gasket is commonly found in the hinged lid to protect the ammunition from moisture damage. The resealing ammunition box is largely a NATO tradition.

For military ammunition, there are strict guidelines on how ammunition is to be handled, and there are various requirements for ammunition boxes, since they have to be capable of withstanding hostile environments, and must be strong enough to protect the ammunition from exploding, should the ammunition box be dropped to a hard surface.

The North Atlantic Treaty Organisation (NATO) has specified ammunition standards including specific requirements for ammunition boxes. The ammunition boxes have to have a specific size, both inside and outside, so that the container is easily recognizable suitable for a specific type of ammunition, and have a specified outer shape and sizes so that the ammunition boxes can be easily be stacked on pallets for bulk transportation. An example of such standardized ammunition boxes is the M19A1 ammunition box for 7.62×51 mm NATO cartridges. Other models of ammunition boxes are used for other types of standard NATO ammunition, where the size of the container reflects the size of the ammunition. In addition to the standardized size and design of the ammunition containers, the containers used for NATO ammunition are required to withstand the extreme environments, to which the ammunition containers are supposed to be in, such as extreme cold and extreme heat and must be able to preserve the ammunition in storage for a minimum of 20 years. In all these conditions the ammunition container must be in working order, so that the ammunition may be transported and accessed without any hindrance. The above requirements may be seen as the normal use requirements for a NATO ammunition container, where there are further requirements for the container that covers extraordinary situations, such as if the container is damaged. The container must be capable of withstanding shocks or impacts within a predetermined range, in order to ensure that the container maintains its mechanical structure for holding and transporting the ammunition in case the container is damaged. The predefined range of tolerance is for example that the container must be able to hold the ammunition, be carried by a handle, and be openable when a container filled with ammunition has been dropped from at height of 12 meters to a hard surface, such as concrete, in a cold environment of −47° C.

Such reliability of NATO ammunition containers has been achieved by constructing the ammunition boxes from steel plating since the mechanical strength of the steel is not significantly affected by change in temperature, within a predetermined range from about −47° C. to 70° C. A steel plating box is also highly resistant to shocks or impacts, meaning that the structural integrity of the ammunition box is maintained even if the container is dropped from a significant height. The steel plating may bulge and be indented after the fall, but the steel construction is stable enough to allow the container to maintain its substantial shape, without disintegrating. Furthermore, the steel ammunition box is of such a mechanical strength that it is capable of being stacked in large bulks on pallets for bulk transportation, where the lowest placed ammunition boxes the stack may bear the weight of approximately 20 fully loaded ammunition containers stacked thereon.

Although steel ammunition boxes have been used since the Second World War (1940s) and have served its purpose fully, steel ammunition boxes have a number of drawbacks. A conventional steel container that fulfils the NATO requirements uses relative thick steel plating, resulting in an ammunition box that has a relatively high weight compared to the weight of the ammunition. This is disadvantageous since ammunition is often transported in bulk to a distant location of deployment by air. Since weight is typically the main load capacity restriction of an airplane, reduced weight is of significant advantage.

Furthermore, even though the material cost of steel is currently relatively low, the assembly and construction of steel cases is relatively expensive, as the steel panels have to be formed into its shape and welded into its shape. This construction is time consuming, either for skilled metal workers or robots that are performing the construction and assembly operations.

Known ammunition boxes in plastic are both designed with ribs that are arranged at a right angle relative to the housing of the box, which is normal design procedure in the plastic industry to increase stiffness. This measure will have some minor resistance to impacts. However, if the impact is too hard, these ribs will not collapse but transfer the impact energy straight into the case where the ribs are attached and therefor cause the wall of the box to break at the connection line.

Thus, there is a need to provide an ammunition box that is lightweight, inexpensive in production and is capable of meeting the minimum standards that are required for use within the NATO alliance.

SUMMARY

It is an object of the invention to provide an improved ammunition box. The foregoing and other objects are achieved by the features of the independent claims.

Further implementation forms are apparent from the dependent claims, the description and the figures.

According to a first aspect there is provided an ammunition box comprising a molded box body of thermoplastic material with an open top, wherein thermoplastic material is Polypropylene or Polyethylene, the box body having four side walls, two of the side walls being generally parallel to opposing side walls, a fixed substantially rectangular bottom wall connecting all four side walls at the bottom of the box body, the fixed bottom wall being generally perpendicular to the four side walls, the four side walls being connected to one another to form four corners of the box body that extend from the bottom to the open top, the molded box body defining a generally rectangular storage space for ammunition on the inside of the side walls and bottom wall, and an integrally molded, hollow and collapsible projection provided on the outer side of the box body at or near each of the four corners.

By providing integrally molded hollow and controllably collapsible projections it is possible to provide the box body of the ammunition box with impacts zones to protect the box body from damage upon impact to the box body. These impact zones act like crumple zones known from the car industry, and collapse during impact while absorbing a substantial amount of the impact energy, thereby protecting the actual wall of the ammunition box from damage. The integrally molded aspect provides maximum strength for the connection between the collapsible projections and the box body, whilst the hollow and collapsible aspect provides an optimal energy observation from impact. The integrally molded hollow and collapsible projections are provided at or near the corners of the box body and these are the most exposed parts of the box body and are thus the parts that are most likely to fail upon impact. Thus, by providing the impacts zones at or near all the four corners of the box body the additional weight increasing material of the projections is only applied there where its most needed, since e.g. providing a complete double wall construction would render the box body too heavy and more expensive to produce. These measures protect the ammunition box and ensure that the actual ammunition box remains intact upon impact, and it is noted that it is not the function of the ammunition box to protect the ammunition from the impact, since the omission is tested and designed to cope with impact without any protection at all.

According to a first implementation of the first aspect the integrally molded hollow and collapsible projection has an elongated hollow shape that defines a lumen extending substantially at a right angle from the bottom wall. By providing an elongated shape defining a lumen, the collapsible projection can be used for securing other parts of the ammunition box to the box body.

According to a second implementation of the first aspect, the integrally molded, hollow and collapsible projection comprises two spaced projection walls that each project from the side walls, the two spaced projection walls are connected by an impact wall that is spaced from a side wall by the two projection walls, the impact wall together with the two projection walls and a portion of a side wall defining the lumen. By providing two projection walls connected by impact wall a solid and reliable collapsible structure is obtained.

According to a third implementation of the first aspect the projection walls project from the side walls at a near right angle, but not at an exact right angle. Preferably, the projection walls extend at a nearly right angle the sidewall. In an implementation the projection walls extend at an angle between 80 and 89°, preferably between 82 and 88 degrees and even more preferable between 88 and 89° to the sidewall of the ammunition box. To the By providing the projection walls at a nearly right angle but not an exact right angle it is ensured that the projection will collapse in a controlled manner upon impact and not cause the projection wall to be pushed into the sidewall of the ammunition box thereby disintegrating box body. If an exact straight angle would be used between the projection walls and the sidewalls on which they are provided, the risk of the collapsible projection not collapsing and thereby passing on most of the energy and force of the impact to the sidewalls is unnecessarily increased.

According to a fourth implementation of the first aspect the impact wall is a substantially planar wall that is substantially parallel with one of the side walls, with the transition between the impact wall and set projection walls preferably being a round transition. A providing a round transition is avoided that the box body has sharp edges that could impede handling and course injury to persons handling the ammunition box.

According to a fifth implementation of the first aspect a peripheral portion of the side walls closest to the open top forms an upright rim that surrounds a substantially rectangular opening to the rectangular storage space. By providing an upright rim that surrounds the opening to the storage space hermetic sealing of the storage space by means of a lid is facilitated.

An according to a sixth implementation of the first aspect the transition between the portion of the side walls that forms the upright rim and the remainder of the side walls that extends from the transition to the bottom wall coincides with a plane that is parallel with the bottom wall.

According to a seventh implementation of the first aspect the side walls are provided with one or more outwardly directed projections at a transition between the portion of the side walls that forms the rim and the remainder of the side walls that extends from the transition to the bottom wall. Thus, an abutment surface for a abutment with the downwardly projecting sidewalls of the lid is provided.

According to an eighth implementation of the first aspect the side walls are provided with a set of closely spaced elongated integrally molded ribs that extend from a position at or near the bottom wall to the transition, a set of closely spaced elongated integrally molded ribs being located near to each of the corners. The set of integrally molded ribs located close to the corners improves the stability of the box body construction in the area that is most exposed.

According to a ninth implementation of the first aspect the integrally molded, hollow and collapsible projection is elongated and extends longitudinally from the transition towards the bottom wall, preferably terminating before the longitudinal extend reaches the bottom wall. But terminating the longitudinal extent of the integrally molded hollow and collapsible projection, it is possible to avoid projections from the box body in the lower region of the box body, thereby allowing the box body to comply with existing requirements to the dimensions of the outer sides of the box body in order for the ammunition box to match receptacles for ammunition boxes in existing weapon systems.

According to a $10^{th}$ implementation of the first aspect the ammunition box further comprises a flat generally rectangular molded lid of thermoplastic material with a shape and size suitable to close the open top, the lid being openable or releasably attached to the box body to selectively close and open the open top.

According to an $11^{th}$ implementation of the first aspect the lid comprises four lid side walls, two of the lid side walls being generally parallel to opposing lid side walls.

According to a $12^{th}$ implementation of the first aspect the lid of the ammunition box is provided with a fixed substantially rectangular top wall connecting all four lid side walls at the top of the lid.

According to a $13^{th}$ implementation of the first aspect the sidewalls of the lid are connected at four corners of the lid, and each of the corner being provided with an integrally molded hollow and collapsible lid projection.

According to a $14^{th}$ implementation of the first aspect the integrally molded hollow and collapsible lid projections form an extension of the hollow and collapsible projections when the lid closes the open top.

According to a $15^{th}$ implementation of the first aspect of the lid is provided with a gasket, such as for example a rubber gasket. The gasket engages the box body to provide a hermetic seal when the lid is secured to the box body.

According to a $16^{th}$ implementation of the first aspect the box body is provided with a handle.

According to a 17$^{th}$ implementation of the first aspect the lid is provided with a handle.

According to a second aspect of the invention there is provided an ammunition box comprising: a substantially rectangular box with molded box body of a first thermoplastic material, the box body defining a rectangular storage space for ammunition, the rectangular storage space opens to one side of the box body, a molded rectangular lid of a first thermoplastic material configured to selectively close and open the opening, a pivot hinge pivotally connecting the lid to the box body, the pivot hinge comprising a first part attached to the box body and a second part attached to the lid, the first part and the second part being molded parts of a second thermoplastic material different from the first thermoplastic material.

By providing a box body of a first thermoplastic material and a hinge of a second thermoplastic material it becomes possible to tailor the properties of the respective thermoplastic materials to the different requirements, especially with respect to strength and rigidity that apply to the box body and to the pivot hinge. The box body to the needs to be relatively flexible and resilient and therefore the thermoplastic material should be relatively soft in order to be able to absorb energy from impact whilst the pivot hinge material should be relatively rigid and strong in order to ensure that the lid will not be separated from the box body upon impact.

According to a first implementation of the second aspect the first part is secured to the box body by a snap fit connection. Thus, a secure and easy to assemble connection is provided between the box body and the first part of the pivot hinge.

According to a second implementation of the second aspect the second part is secured to the lid body by a snap fit connection. Thus, a secure and easy to assemble connection is provided between the lid and the second part of the pivot hinge.

According to a third implementation of the second aspect the first part defines a hinge pin and the second part defines a bore wherein the hinge pin is pivotally received or the second part defines a hinge pin and the first part defines a bore wherein the hinge pin is pivotally received. Thus, an effective and reliable pivot hinge is provided.

According to a fourth implementation of the second aspect the box body is provided on its outer side with an integrally molded hollow projection that defines a lumen opening towards the side of the box with the opening, the lumen being configured to receive a portion of the first part. Thus, the box body is provided with means to protect it from impact by absorb the energy of the impact without passing too much of it on to the box body, and the projection simultaneously acts as a component that is used to secure the first part of the pivot hinge to the box body.

According to a fifth implementation of the second aspect the molded rectangular lid is provided on an outer side an integrally molded hollow projection that defines a lumen opening towards the side of the lid that faces the opening when the lid is in its closed position, the lumen being configured to receive a portion of the second part. Thus, a double function is created for the projection that functions both as an impact absorbing element and as an attachment element for securing the second part of the pivot hinge.

According to a sixth implementation of the second aspect the first thermoplastic material is Polypropylene or Polyethylene, preferably with additives for extended temperature range and/or for UV protection and/or for electro static discharge protection and/or for flammability performance. Engineering grade polypropylene provides the required balance between strength and rigidity that is required for the box body to be able to flex and absorb while maintaining integrity. Engineering grade polyethylene also provides the required balance between strength and rigidity that is required for the box body to be able to flex and absorb while maintaining integrity.

According to a seventh implementation of the second aspect the second thermoplastic material is polyamide, preferably PA6 (Nylon), even more preferably with fiber reinforcement such as for example glass fiber reinforcement. Engineering grade polyamide provides the required balance between strength and rigidity that is required for the hinge to remain intact upon impact.

According to a third aspect there is provided an ammunition box comprising a substantially rectangular box with a molded box body of a first thermoplastic material, the box body defining a rectangular storage space for ammunition, the rectangular storage space opens to an open side of the box body, a molded rectangular lid of a first thermoplastic material configured to selectively close an open the opening, a peripheral area of the box body adjacent the open side being formed as a rim surrounding and opening to the storage space, the lid being shaped and sized to fit snugly around the rim with the rim being received inside the lid when the lid is in a closed position, the lid being provided on one of its outer sides with two spaced integrally molded hollow projections that each define a lumen opening towards the side of the lid that faces the opening when the lid closes the opening, an outer side of the box body being provided with two spaced tongues, the tongues having a main extend that is parallel with the rim and the tongues being marginally spaced from the rim, the spacing between the tongues corresponding to the spacing between the lumen and the tongues being received in the lumen when the lid is in its closed position.

By providing the box body with tongs that project into corresponding lumen of the lid, the connection between the box body and the lid is significantly improved when the lid is in the closed position, thereby improving the overall capacity of the ammunition box to remain intact upon impact.

According to a first implementation of the third aspect an outer side of the box is provided with two integrally molded hollow projections that each define a lumen that opens towards the open side of the box body, the tongues being formed by two elongated bodies, one of the elongated bodies being inserted in each of the lumen with the lug protruding from the lumen. By providing two integrally molded hollow projections that define a lumen the box body is provided with impact zones for protection from impact and with means for securing the tongues to the box body.

According to a second implementation of the third aspect the two elongated bodies are part of an H-shaped bracket wherein the elongated bodies are connected by a transverse member with the spacing between the elongated bodies corresponding to the spacing between the lumen in the two integrally molded hollow projections. By providing the two tongues is an integral part of an H-shaped bracket, it becomes easier to secure the tongues to the box body during assembly. Further, the H-shaped bracket provides for transverse member that can be used for securing other parts of the ammunition box.

According to a third implementation of the third aspect the elongated bodies are secured to the box body by a snap fit connection. By providing a snap fit connection the allocated bodies can be easily secured to the box body during assembly.

According to a fourth implementation of the third aspect the transverse member is provided with a portion of a pivot hinge for a clasp, the clasp being pivotally suspended from the ammunition box and the clasp being configured to engage the lid in one pivotal position for locking the lid and supplies being configured to disengage the lid in another pivotal position.

According to a fifth implementation of the third aspect the elongated bodies and/or the H-shaped bracket are molded from a second thermoplastic material different from the first thermoplastic material. Thus, the material properties of the elongated body and/or the H-shaped bracket can be adapted to their specific needs, whilst the box body can be provided with material properties that are adapted to the needs of the box body.

According to a sixth implementation of the third aspect the clasp is molded from a third thermoplastic material different from the first thermoplastic material and different from the second thermoplastic material. Thus, the clasp material can be adapted to the specific needs of the clasp, which needs to be strong and resilient in order to perform its task.

According to a seventh implementation of the third aspect the first thermoplastic material is Polypropylene or Polyethylene, preferably with additives for extended temperature range and/or for UV protection and/or for electro static discharge protection and/or for flammability performance.

According to an eighth implementation of the third aspect the second thermoplastic material is polyamide, preferably PA6 (Nylon), even more preferably with fiber reinforcement such as for example glass fiber reinforcement.

According to a ninth implementation of the third aspect the third thermoplastic material is polyamide, preferably PA6, either fiber reinforced or with softener.

According to a fourth aspect there is provided an ammunition box comprising a rectangular box body and a corresponding lid, the box body being a molded body of a thermoplastic material with an opening on one side of the box body that gives access to a rectangular storage space for ammunition inside the box body, the lid being pivotally suspended from the box body by a pivot hinge at or near one of the sides of the sides of the box body and near the opening for allowing the lid to pivot relative to the box body between a closed position and a fully open position, a peripheral area of the box body adjacent the opening forming a rim around the opening, the lid being shaped and sized to fit snugly around the rim with the rim being received inside the lid when the lid is in the closed position, wherein the rim is provided with one or more outwardly projecting teeth at the side of the box where the pivot hinge is provided, and the lid is provided with corresponding recesses for receiving the teeth when the lid is in the closed position.

By providing the rim with outwardly projecting teeth at or near the pivot hinge, with the teeth projecting into corresponding recesses in the inner side of the lid when the lid is in the closed position, the lid is additionally secured to the box body when the lid is in the closed position, thereby improving the capacity of the ammunition box to prevent the lid from being disengaged from the box body.

According to a first implementation of the fourth aspect the one or more outwardly projecting teeth are integrally molded with the box body.

According to a second implementation of the fourth aspect the teeth are spaced in the axial direction of the pivot hinge.

According to a fifth aspect there is provided an ammunition box comprising a rectangular box body and a corresponding lid, the box body being a molded body of a thermoplastic material with an opening on one side of the box body that gives access to a rectangular storage space for ammunition inside the box body, the lid being openable attached to the box body for allowing the lid to assume a closed position and an open position, a peripheral area of the box body adjacent the opening forming a rim around the opening, the lid being shaped and sized to fit snugly around the rim with the rim being received inside the lid when the lid is in the closed position, wherein two opposing side walls of the rectangular box body are provided with a pair closely spaced ribs that are interconnected by a plurality of traverse or squint ribs, the pair of closely spaced ribs extending along the transition between the rim and the remainder of the sidewall on which the pair of closely spaced ribs are provided.

By providing a pair of closely spaced ribs that are interconnected by traverse or squint ribs at the transition between the rim and the remaining part of the sidewall, the capacity of the sidewall to resist being flexed inwardly by outside pressure on the sidewall is significantly increased. Thus, it becomes more difficult for persons to gain access to the start space inside the ammunition box without removing the lid.

According to a sixth aspect there is provided an ammunition box comprising a rectangular box body and a corresponding rectangular flat lid, the box body being a molded body of a thermoplastic material with an opening on one side of the box body that gives access to a rectangular storage space for ammunition inside the box body, a peripheral area of the box body adjacent the opening forming a rim around the opening, the lid comprising an integrally molded lid body, the lid being shaped and sized to fit snugly around the rim with the rim being received inside the lid when the lid is in the closed position, the lid body has a top wall that is connected to four lid side walls at a substantially right angle and the four lid side walls fit snugly round the rim, the top wall having a plurality of integrally molded lid ribs projecting from the inner side of the lid, the lid being provided with an closing plate, one side of the closing plate facing the lid ribs and the one side of the closing plate being supported by the lid ribs, the closing plate being provided with two oppositely disposed flanges that extend along two opposite lid side to define a groove in which a portion of the upright flange of the box body is received with a snug fit when the lid is mounted on the box body.

By providing a groove on the inner side of the lid, the capacity of the sidewall to resist being flexed inwardly by pressure on the outer side of the sidewall is significantly increased. Thus, becomes more difficult for persons to gain access to the storage space inside the ammunition box without removing the lid by forcing the sidewall inwards.

According to a first implementation of the sixth aspect an end of the at least on lid rib is located at the inner side wall of the flanges order for the end of the at least one lid rib to form an abutment surface for preventing the flange from being pressed inwardly.

These and other aspects of the invention will be apparent from and the embodiments described below.

BRIEF DESCRIPTION OF THE DRAWINGS

In the following detailed portion of the present disclosure, the invention will be explained in more detail with reference to the example embodiments shown in the drawings, in which.

DETAILED DESCRIPTION

Figure 1:
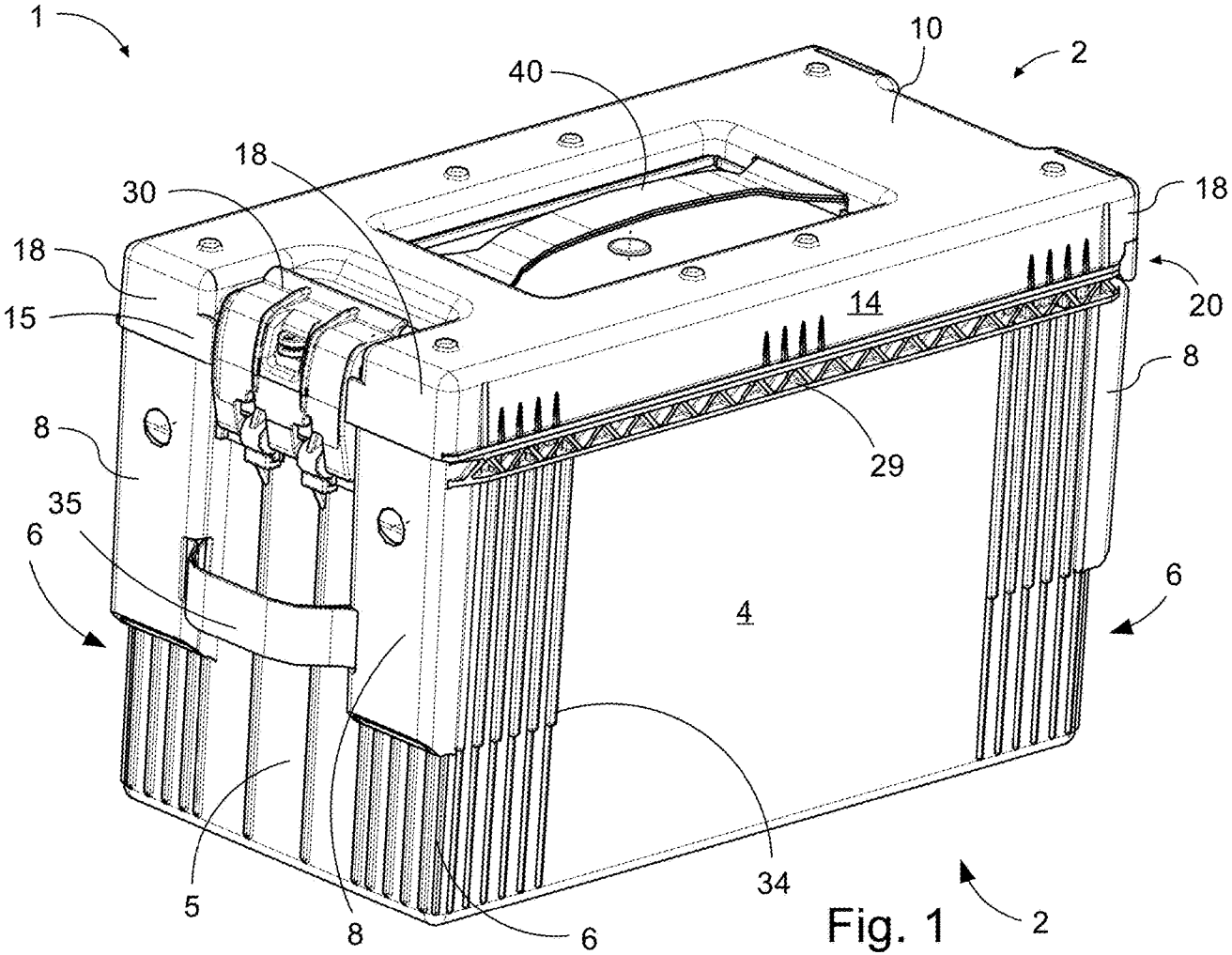
FIG. 1 is a perspective view of an ammunition box according to an example embodiment.
Figure 2:
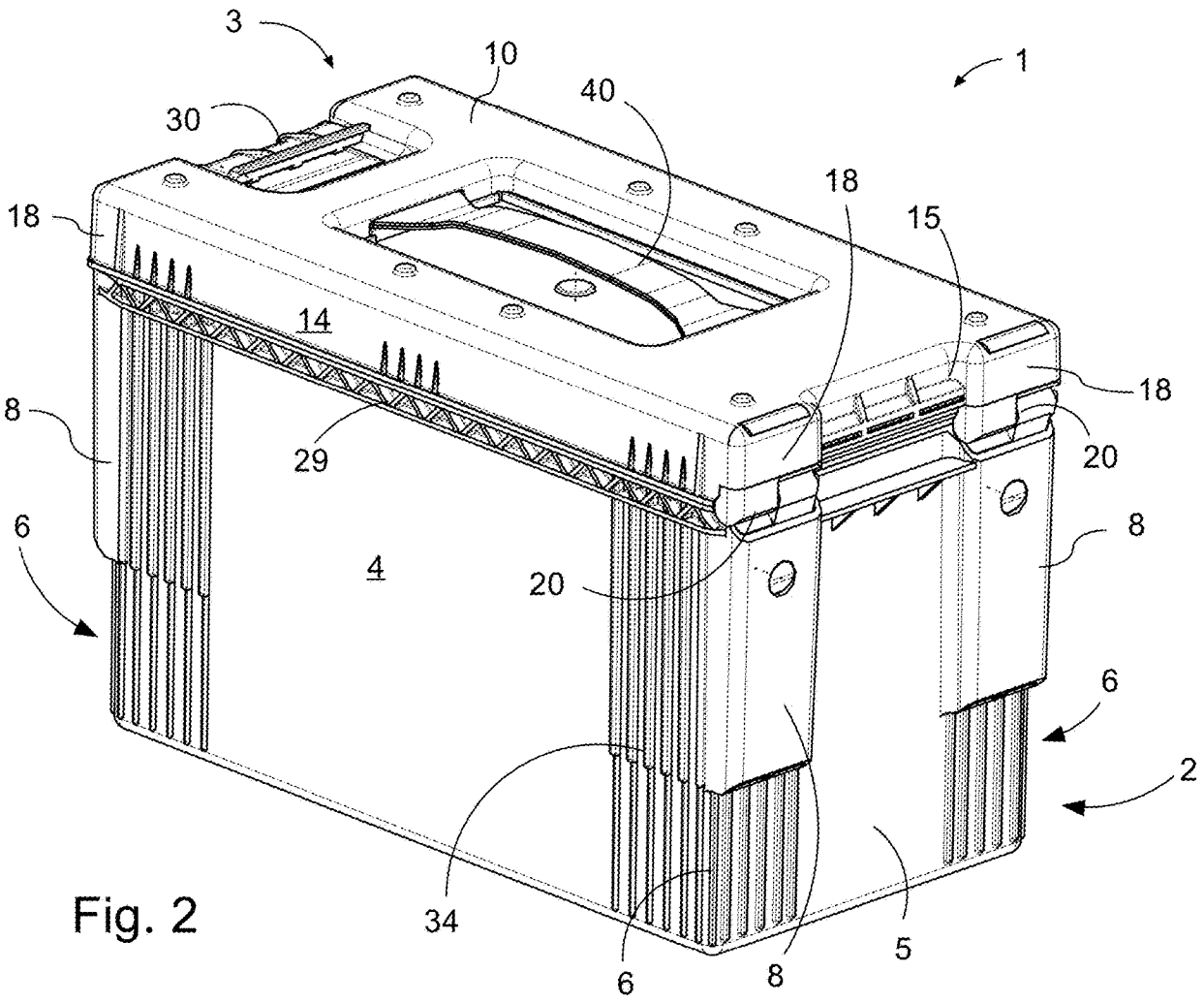
FIG. 2 is a another perspective elevated view of the ammunition box of FIG. 1 with its lid in the closed position.
Figure 3:
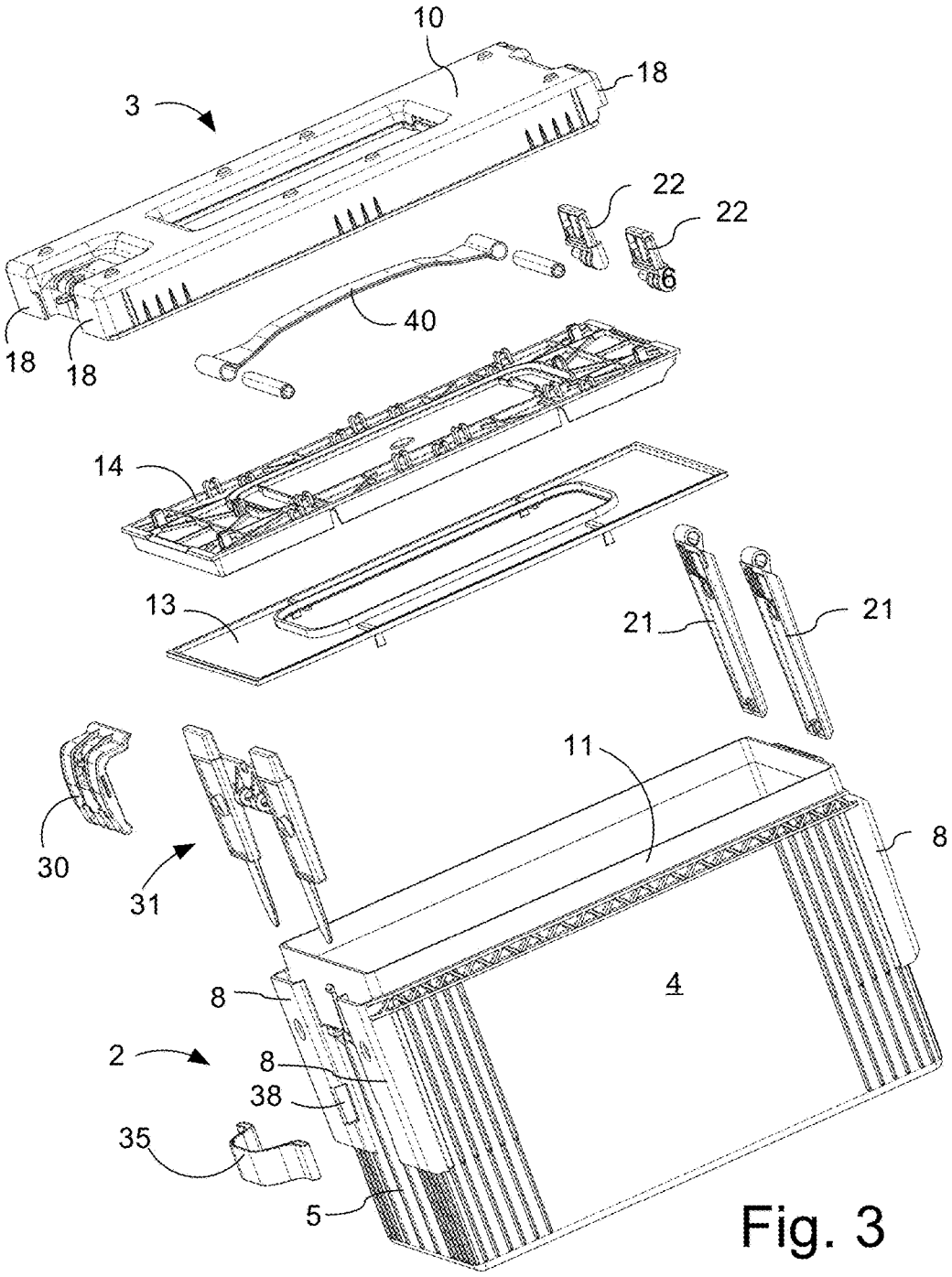
FIG. 3 is an exploded view of the ammunition box of FIG. 1 with its lid in the closed position.
Figure 4:
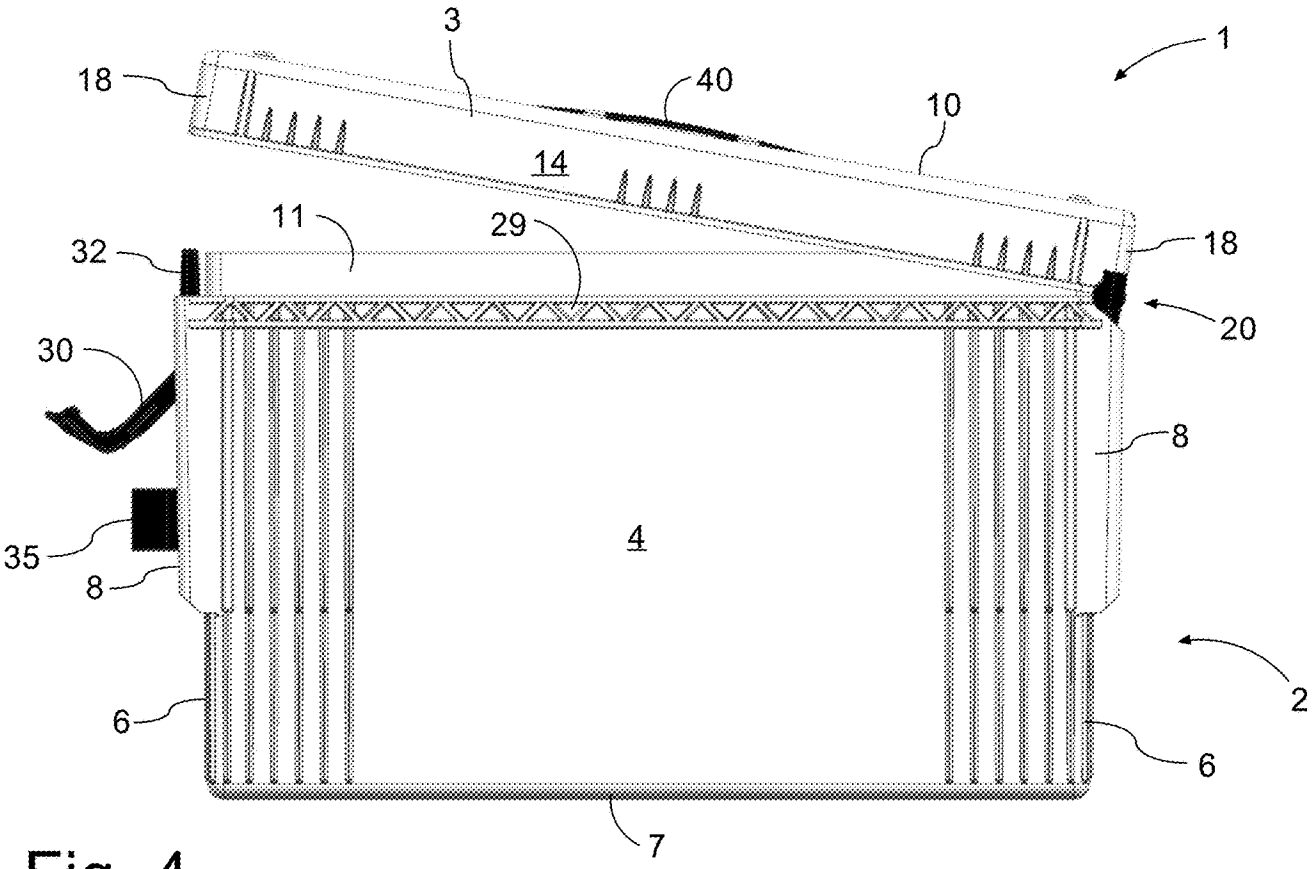
FIG. 4 is a side view of the long side of the ammunition box of FIG. 1, with its lid in a slightly open position
Figure 5:
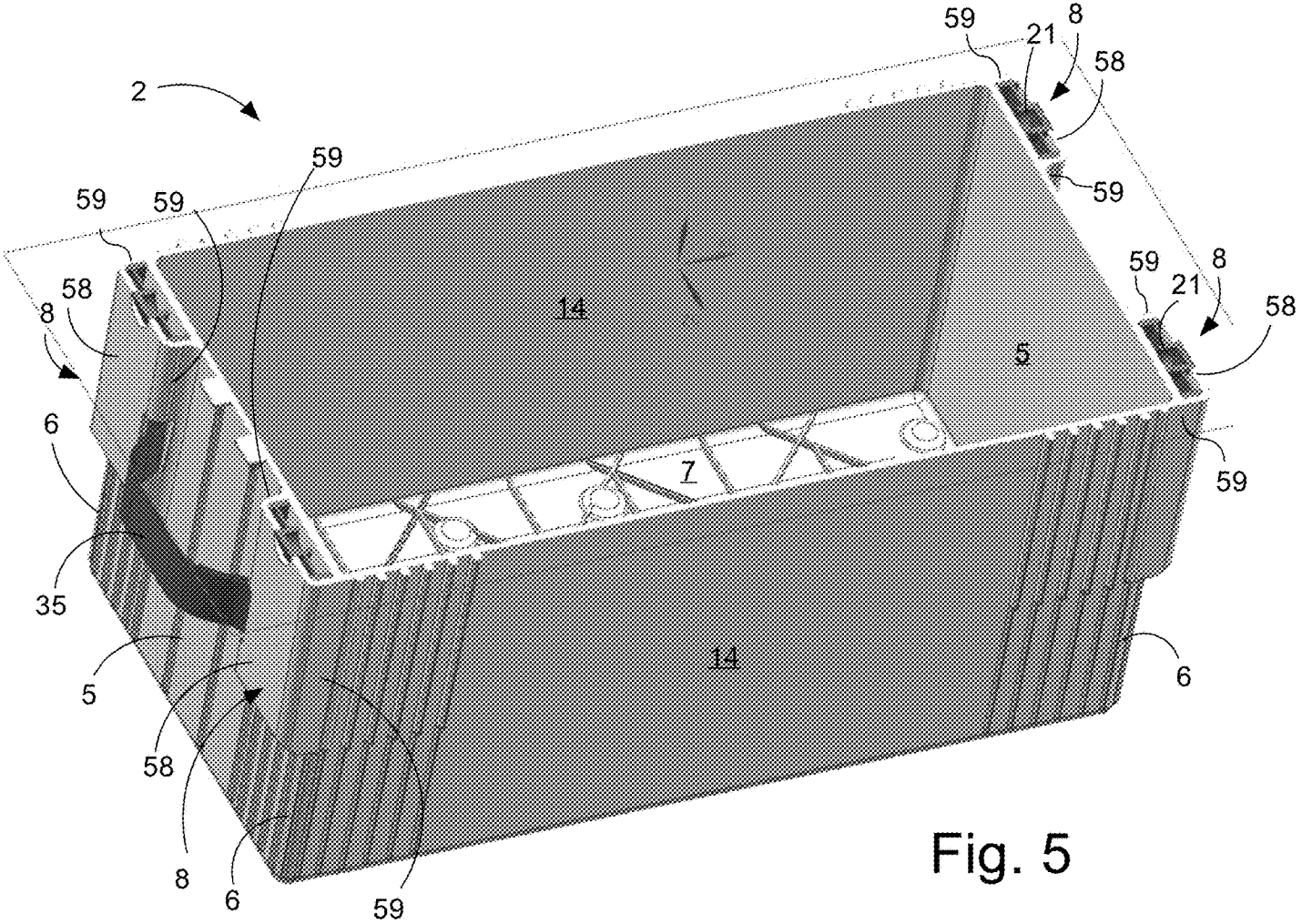
FIG. 5 is an elevated sectional cutaway view of the ammunition box of FIG. 1.
Figure 6:
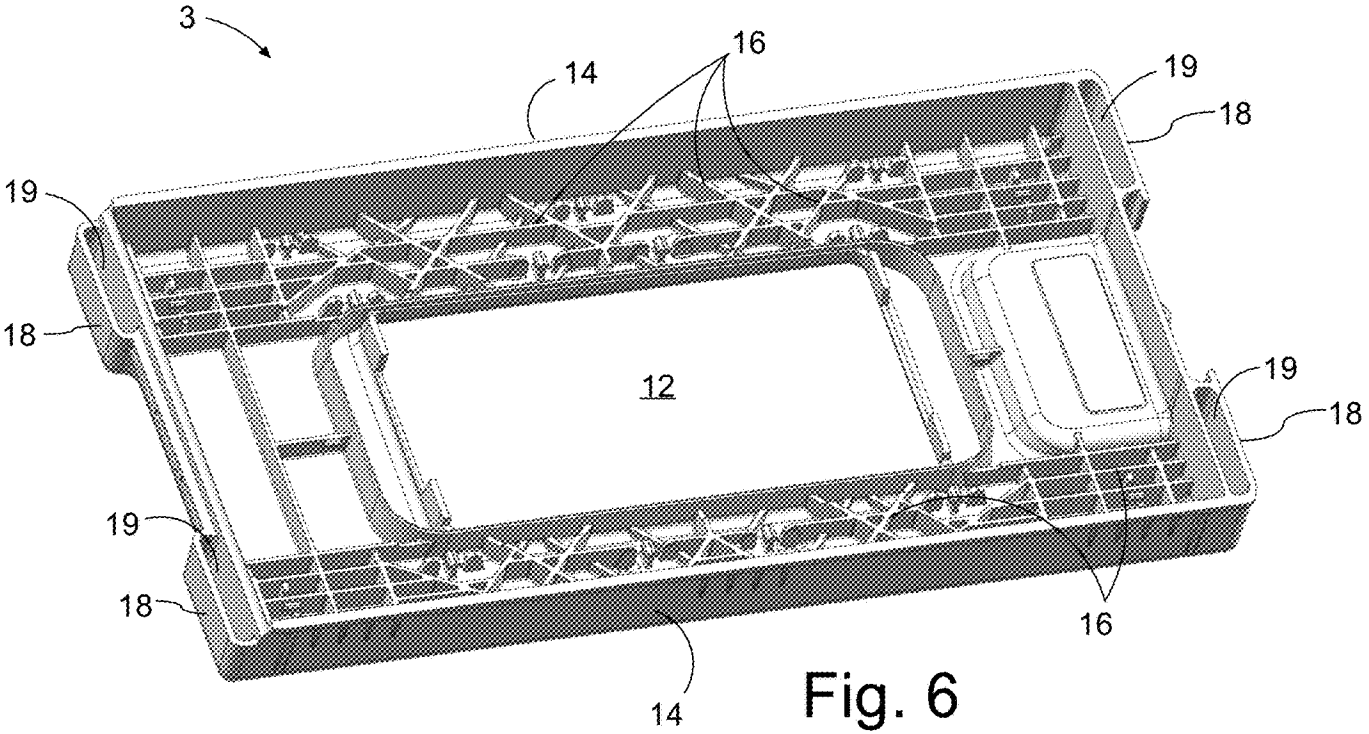
FIG. 6 is an elevated view of the bottom side of the lid of the ammunition box of FIG. 1, without its closing plate.
Figure 7:
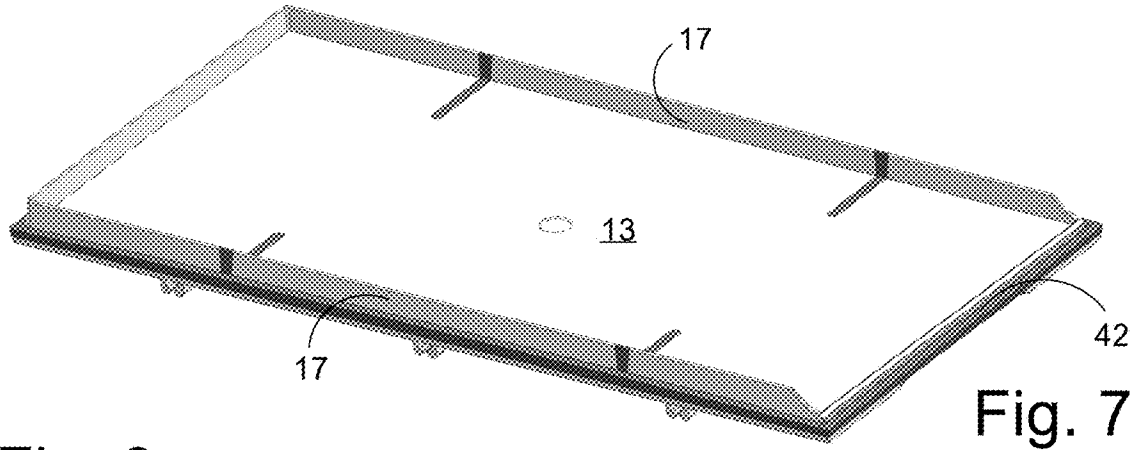
FIG. 7 is an elevated view of the closing plate of FIG. 6.
Figure 8:
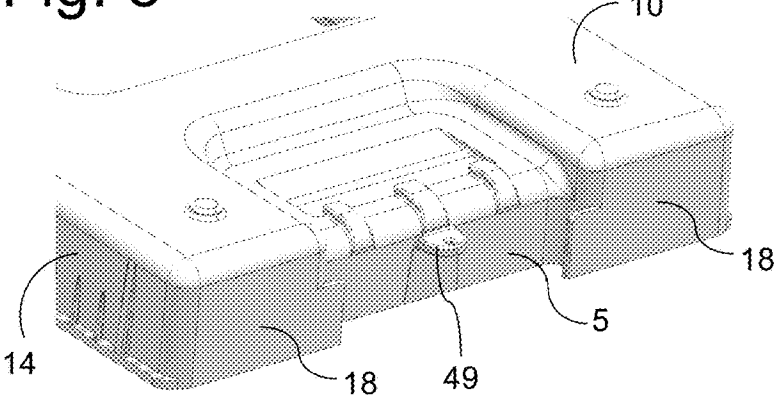
FIG. 8 is an elevated view of a detail of the short side of the lid of FIG. 6.
Figure 9:
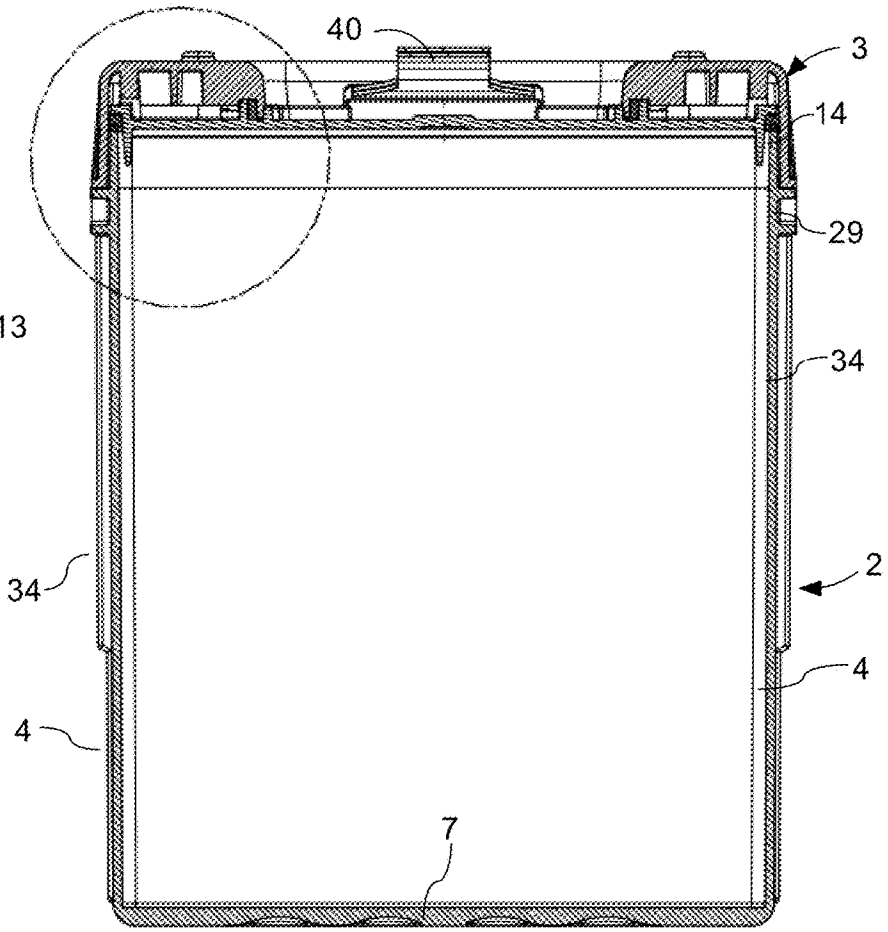
FIG. 9 is a cross-sectional view through middle of the ammunition box of FIG. 1.
Figure 10:
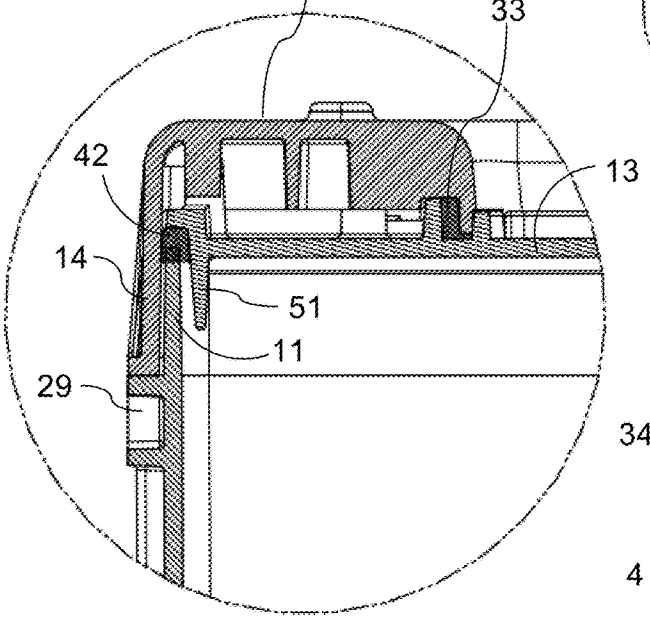
FIG. 10 is a detail of the sectional view of FIG. 9.
Figure 11:
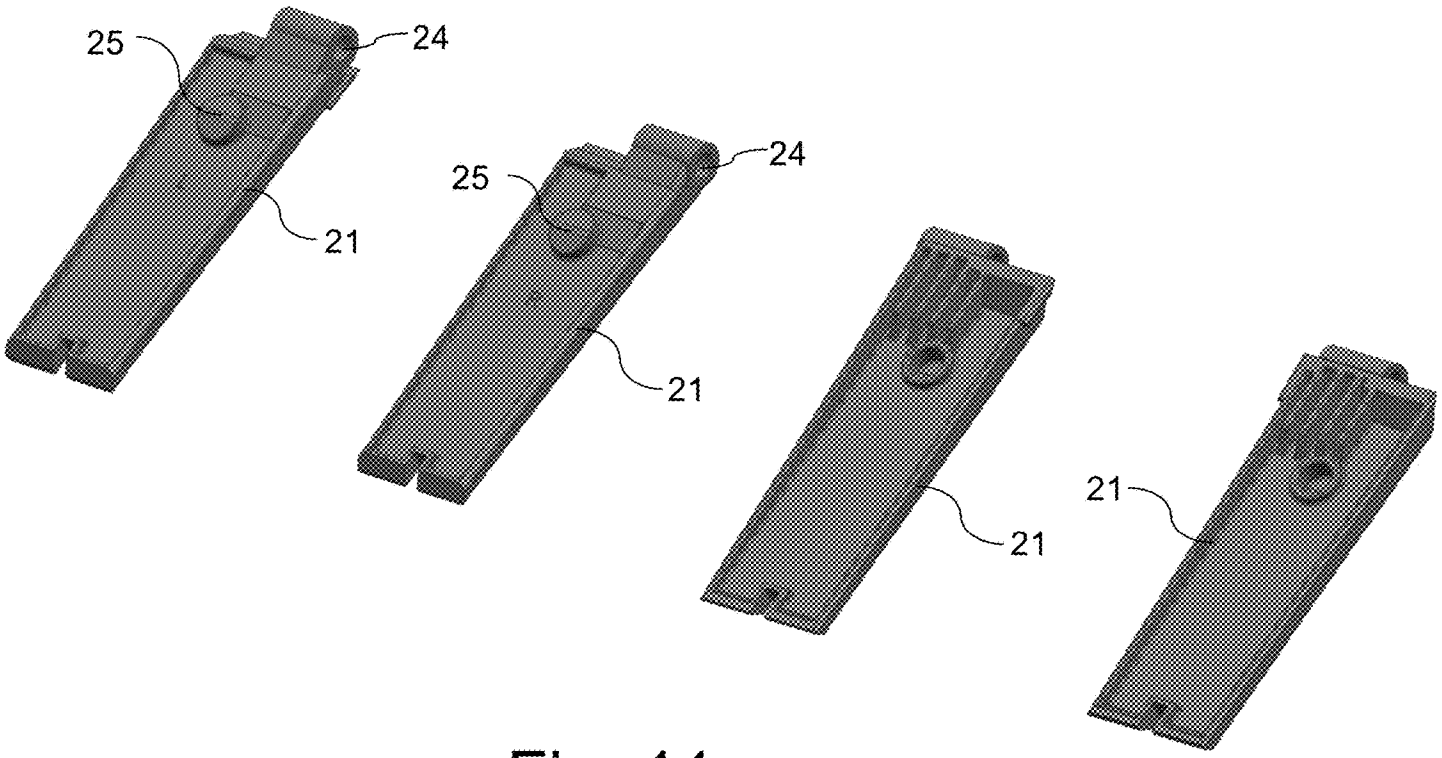
FIG. 11 is an elevated view from two opposite sides on to first parts of two pivotal hinges.
Figure 13:
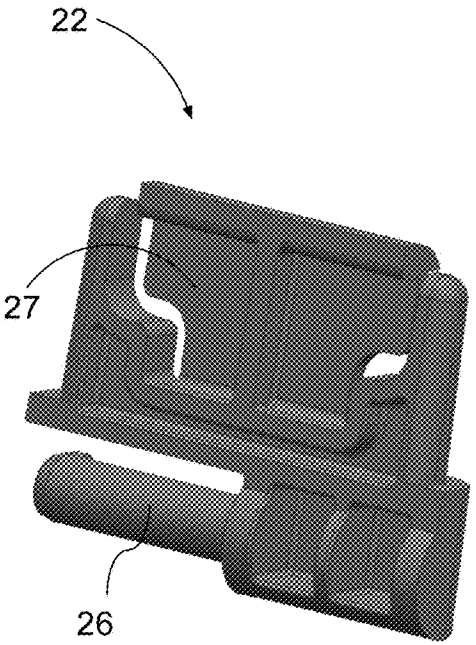
FIGS. 12 and 13 are an elevated views from two different perspectives on the second part of a pivotal hinge.
Figure 12:
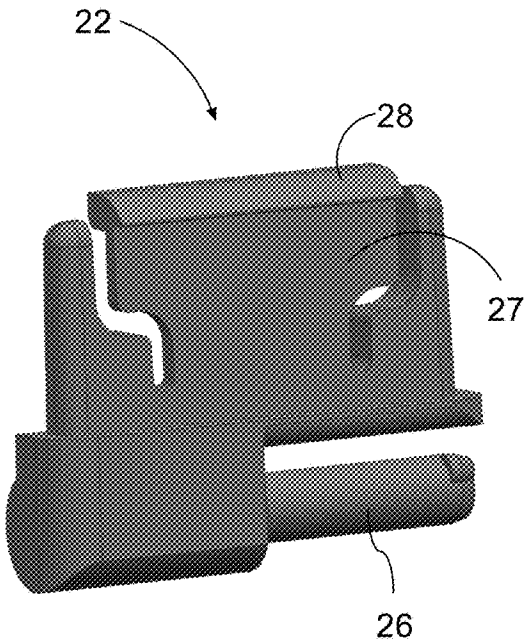
Figure 14:
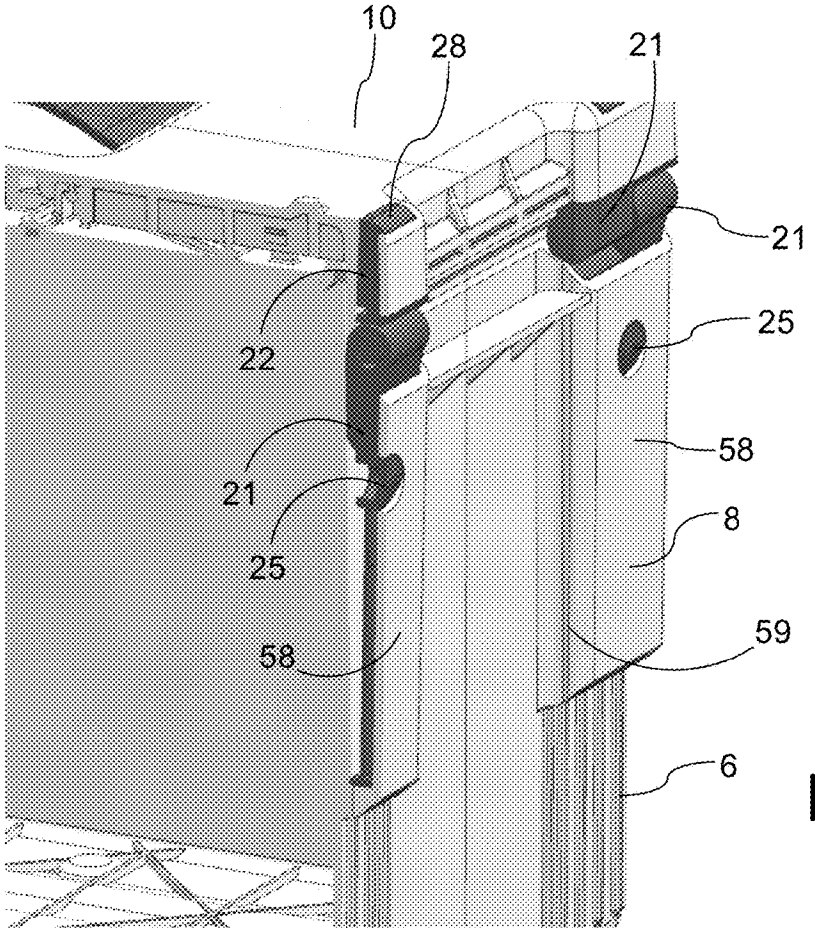
FIG. 14 is an elevated sectional cutaway view on a short side of the ammunition box of FIG. 1 through one of the pivotal hinges.
Figure 15:
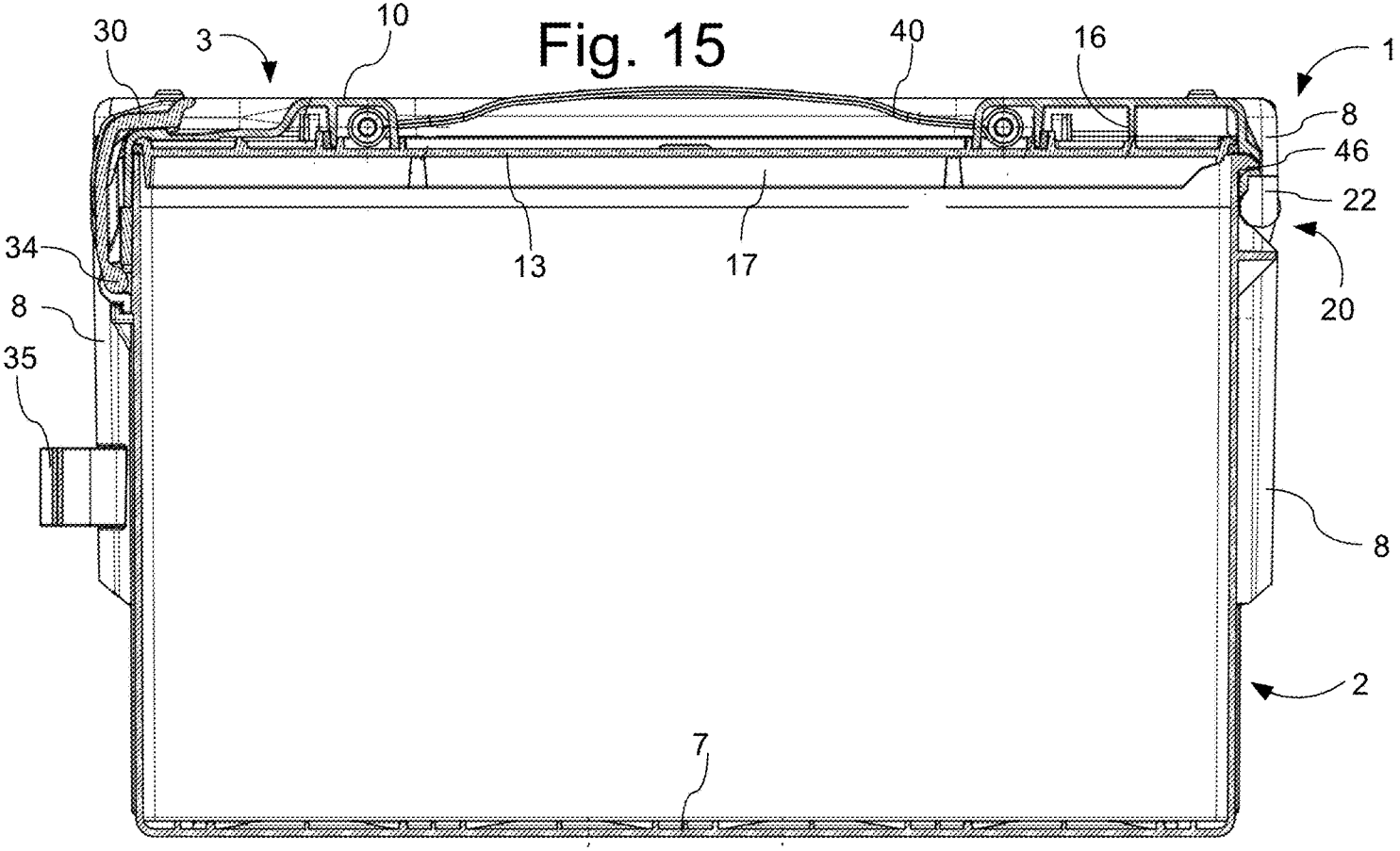
FIG. 15 is a longitudinal sectional view through the middle of the ammunition box of FIG. 1, FIGS. 16 and 17 are detailed longitudinal sectional views through an area of the ammunition box of FIG. 1 at the pivotal hinge, with FIG. 16 showing the lid in a closed position and FIG. 17 showing the lid in a somewhat open position.
Figure 17:
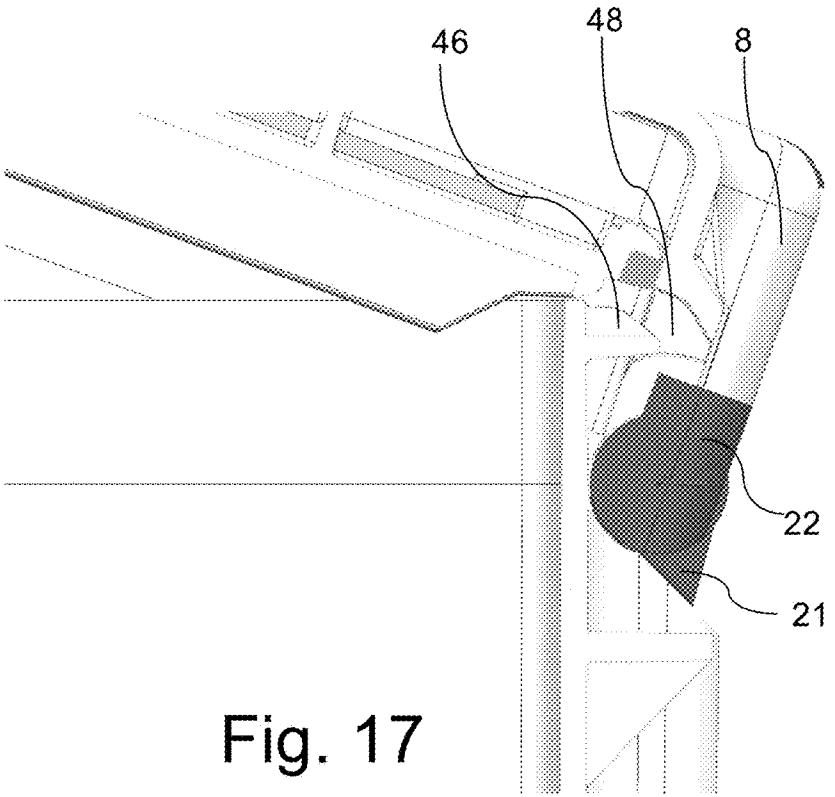
Figure 16:
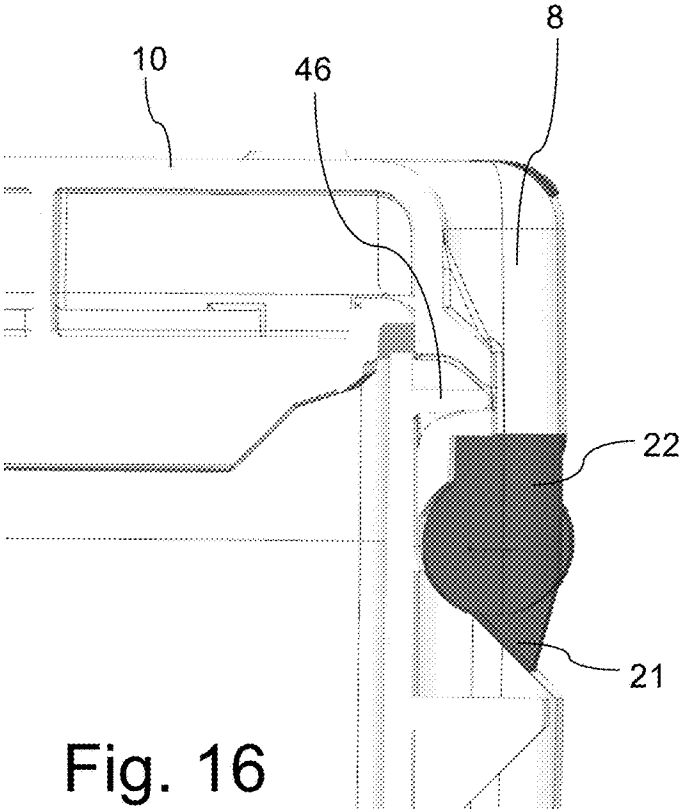
Figure 19:
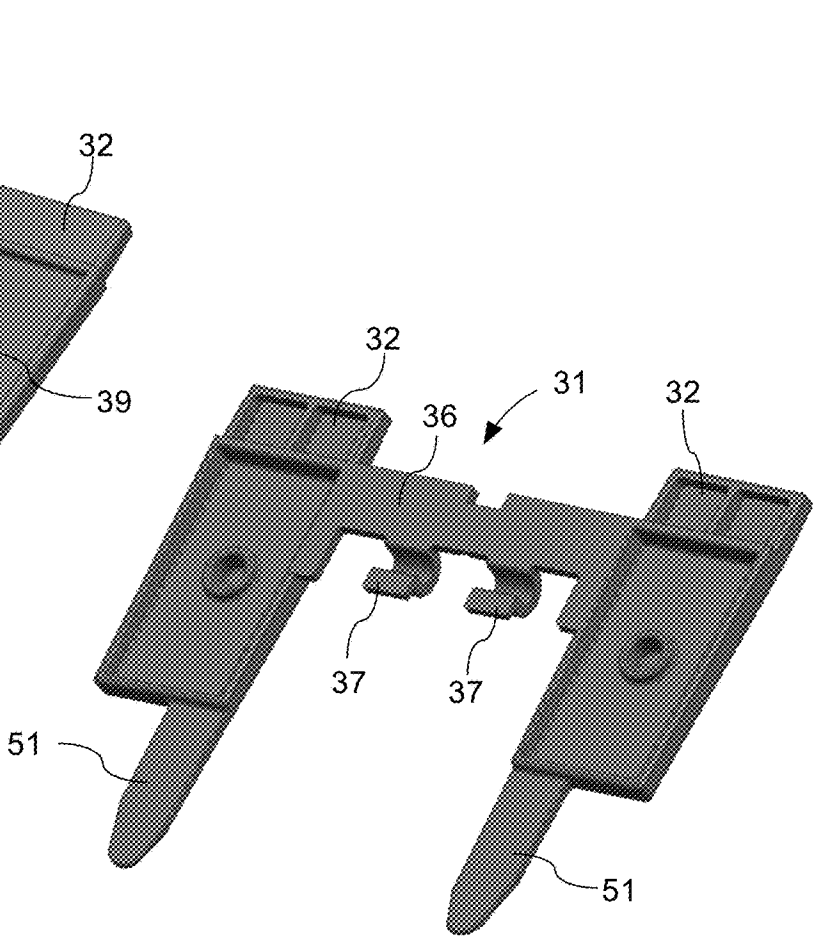
FIGS. 18 and 19 are two elevated views from opposite sides on an H-shaped bracket that is provided at a short side of the ammunition box of FIG. 1, FIGS. 20 and 21 are two elevated views from opposite sides on an L-shaped clasp that is provided at a short side of the ammunition box of FIG. 1.
Figure 18:
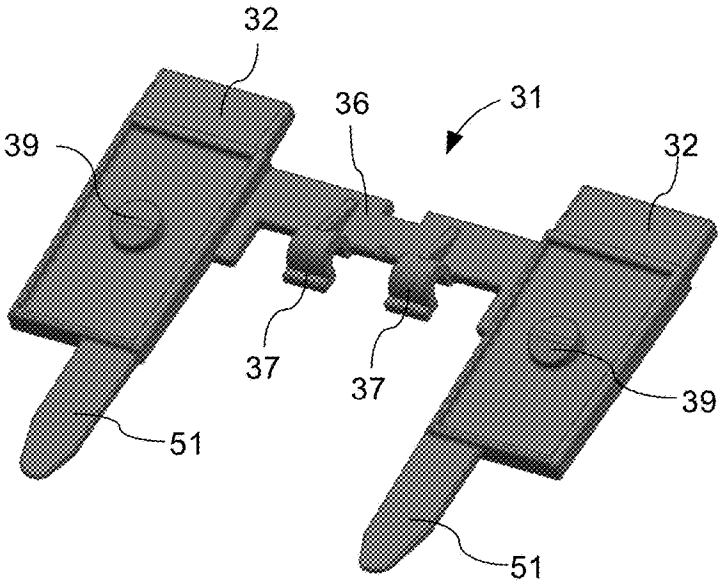
Figure 21:
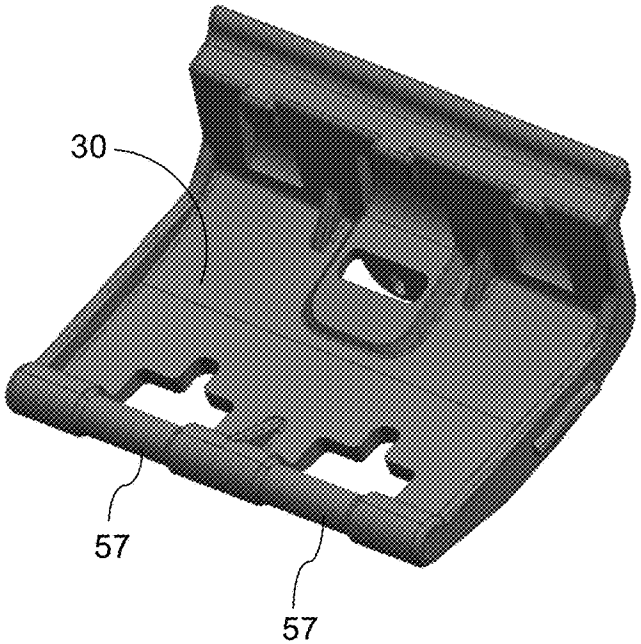
Figure 20:
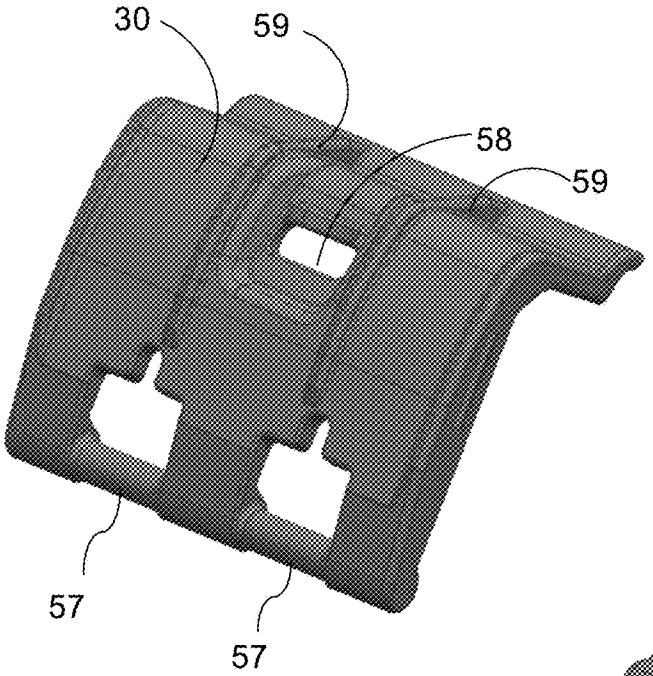
Figure 22:
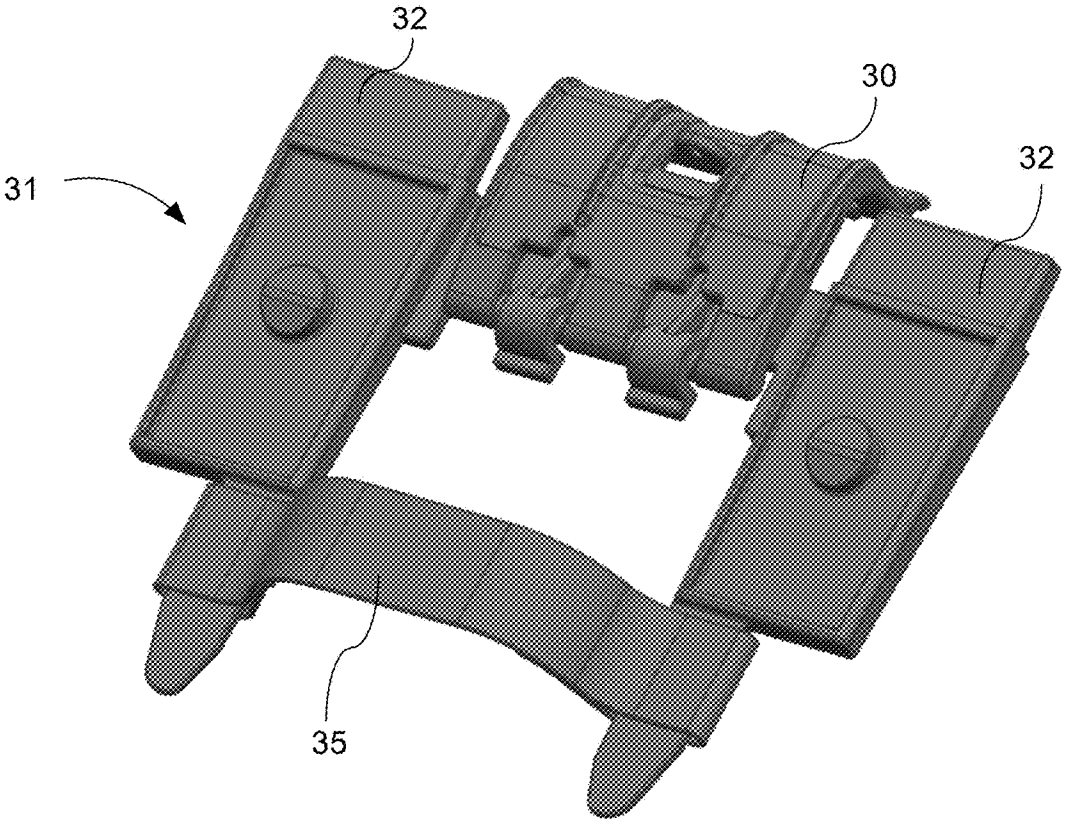
FIG. 22 is an elevated view of an assembly including the H-shaped shaped bracket of FIGS. 18 and 19, the L-shaped clasp of FIGS. 20 and 21 and the handle shown in FIG. 1.
Figure 23:
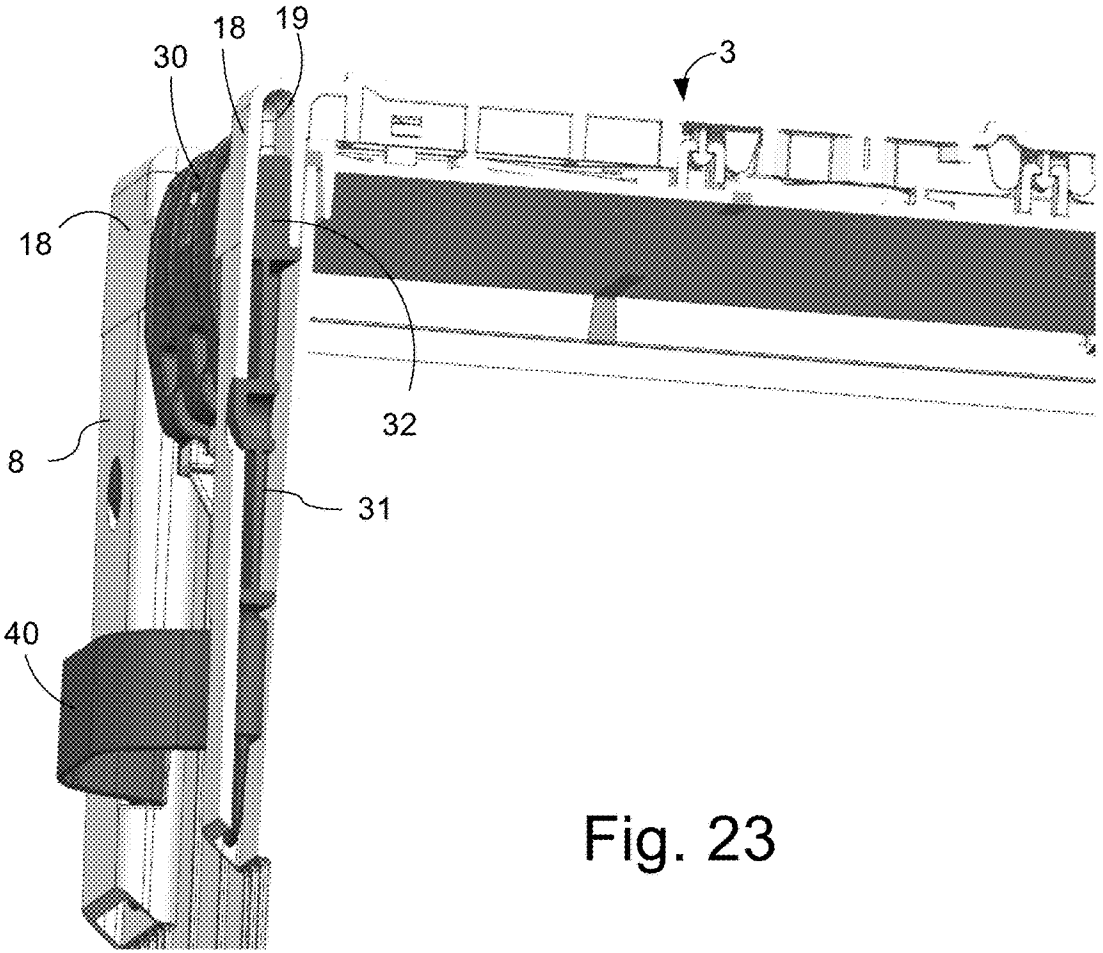
FIG. 23 is an elevated sectional cutaway view through a an end portion of the ammunition box of FIG. 1, FIGS. 24 and 25 illustrate teeth that project from a flange of the box body of the ammunition box of FIG. 1, into the side of the lid when the letter is in its closed position.
Figure 24:
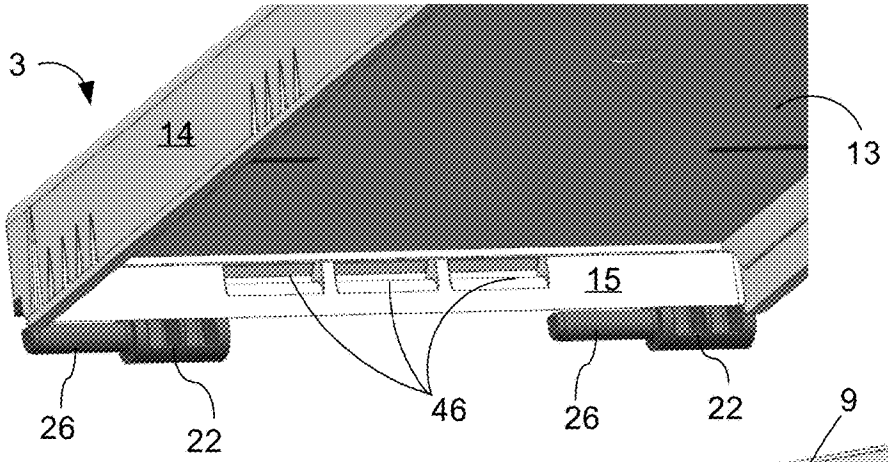
Figure 25:
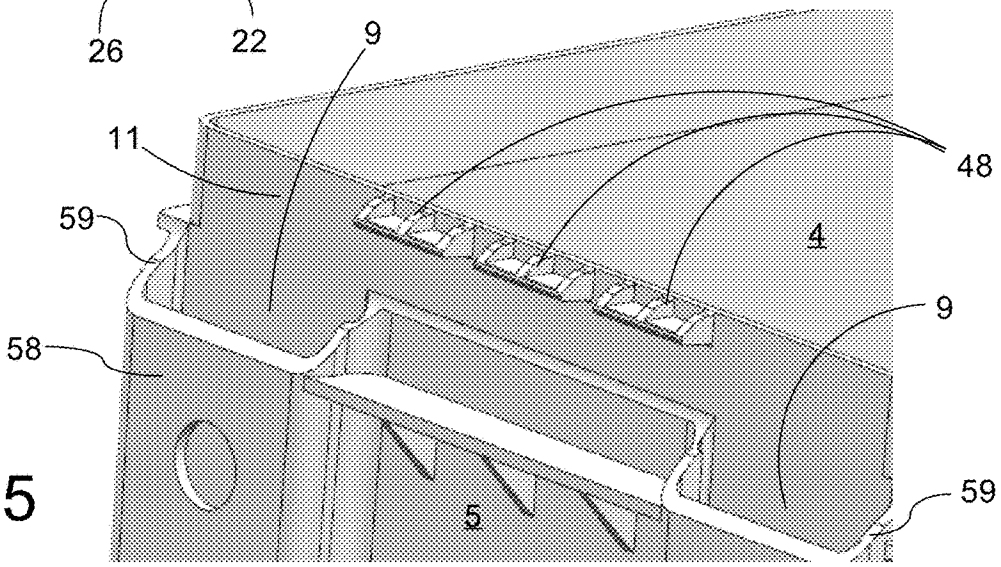

With reference to the figures there is disclosed an ammunition box 1 with a generally rectangular outline.

The ammunition box includes a molded box body 2 of a first thermoplastic material, i.e. a material of synthetic or semi-synthetic organic solids that are malleable when warm. The molded box body 2 defines an essentially rectangular storage space for storing ammunition or other items with similar properties, such as explosives.

One side of the essentially rectangular box body is open to give access to the storage space inside the box body 2. The other sides of the box body 2 are formed by two opposite parallel sidewalls 4 at the four long sides of the box body and two opposite parallel sidewalls 5 at the short sides of the box body 2. A bottom wall 7 is connected to the four sidewalls 4,5 at an essentially right angle. In an embodiment the bottom wall 7 is provided with a plurality of internally projecting reinforcement ribs. The four sidewalls 4,5 are connected to each other to form four corners 6 of the box body 2.

The ammunition box 1 also includes a flat and essentially rectangular lid 3 with a shape and size that is suitable to close the opening of the box body 2. The lid includes a molded body of the first thermoplastic material. The lid 3 has a top wall 10 that connects at right angles with four side walls 14,15, i.e. two opposing sidewalls 14 along the long sides of the lid 3 and two opposing sidewalls 15 along the short sides of the lid 3. The long side walls 14 and the short side walls 15 are connected to one another to form the corners of the lid body.

One of the short side walls 5 of the box body is provided with a handle 35 and the top wall 10 of the lid 3 is provided with a handle 40.

In the shown embodiment, the lid 3 is pivotally connected to the box body 2 by a pivot hinge 20 that is located at the short side of the ammunition box 1. A locking device in the form of a clasp 30 is provided the opposite short side of the ammunition box 1 (according to another embodiment (not shown) the lid 3 is secured to the box body 2 by clasps at opposite sides of the ammunition box 1).

The box body 2 is at each of its four corners 6 provided with an integrally molded hollow collapsible projection 8. The integrally molded hollow collapsible projections 8 each form a hollow collapsible structure that can absorb energy upon impact without transferring large forces to the box body 2.

The collapsible projections 8 have an elongated shape and each define a lumen 9 between two spaced projection walls 59. The two spaced projection walls 59 are connected to one another by an impact wall 58. The impact wall 58 is spaced from the sidewall 14,15 with which the collapsible projection 8 is associated. In an embodiment the impact wall 58 is a substantially planar section of wall that extends parallel with the sidewall 14, 15 with which the impact wall is associated. The transition between the impact wall 58 and the projection walls 59 is preferably a rounded transition.

The collapsible projection 18 is arranged near or at the corner 6, i.e. there where the impact is most likely. The longitudinal extent of the lumen 9 is preferably parallel with the corner 6 with which the collapsible projection is associated. The lumen 9 opens to the side of the box body 2 that is provided with the opening to the storage space. The opposite end of the lumen 19 can in embodiment also be open.

According an embodiment the integrally molded, hollow and collapsible projection 8 is elongated and extends longitudinally from the transition between the rim 11 and the remainder of the side wall 4,5 concerned towards the bottom wall 7, preferably terminating well before the longitudinal extend reaches the bottom wall 7.

The top of the box body 2 is provided with a circumferential upstanding rim 11 around the opening i.e., the upper periphery of the sidewalls is formed by the rim 11. The sidewalls are provided at the transition between the rim 11 and the remainder of the sidewalls 4,5 with upwardly facing abutment surfaces for engaging downwardly facing abutment surfaces of the sidewalls 14,15 of the lid 3.

In an embodiment the long sidewalls 4 are provided on their outer side with a pair of preferably integrally molded closely spaced ribs 29 that are interconnected by a plurality of traverse or squint ribs. The pair of closely spaced ribs 29 preferably extends along the transition between said rim and the remainder of the sidewall on which the pair of closely spaced ribs 29 are provided. The upper of the pair of closely spaced ribs 29 can thus form an abutment surface for the lid 3.

The sidewalls 4, 5 are provided with a plurality of closely spaced set of reinforcement ribs 34 at or near the corners 6 of the box body, with the reinforcement ribs 34 extending from the bottom of the box body 2 towards the top of the box body 2.

The rim 11 is intended to be tightly received inside the lid 3.

The lid body is at each of its four corners provided with corresponding integrally molded collapsible projections 18. Equally, the collapsible lid projections 18 each define a lumen 19 that opens to the side of the lid that faces the opening to the storage space of the ammunition box 1 when the lid 3 is secured to the box body 2. The collapsible lid projections 18 are formed by lid projection walls that project from the lid body. The lid protection walls are connected to one another by a lid impact wall that is spaced from the sidewall of the lid body to form a hollow collapsible structure that can absorb energy upon impact without transferring large forces to the lid body. When the lid 3 is in the closed position, the collapsible lid projections 18 form an extension of the collapsible projections 8, in order to protect the corners of the ammunition box 1 all the way to the top of the ammunition box 1.

The top wall 10 of the lid body is provided with an opening 12 that serves to provide space for the handle 40.

The top wall 10 of the lid body is provided with inwardly projecting lid ribs 16 that enhance the stability of the lid body. The projecting lid ribs 16 also form a support structure for a closing plate 13 that is secured to the inner side of the lid body. The closing plate 13 is provided with two opposite (downwardly projecting) flanges 17 along the long sides of the lid 3. The flanges 17 define together with a corresponding sidewall 14 a groove for tightly receiving the rim 11 of the box body.

The closing plate 13 is also provided with a circumferential gasket 42 (such as e.g. a rubber gasket) that seals against the upper edge of the rim 11 so that the lid 3 can hermetically seal the box body 2. The short side of the lid 3 opposite to the side of the hinge 20 is provided with a lug 49 that is intended to project through an opening 58 in the clasp 30. Thus, a seal can be arranged through an opening in the lug 49 to verify that the ammunition box 1 has not been opened because the seal has not been broken.

The closing plate 13 also seals off the hole 12 lid body, preferably using a circumferential gasket 33 to ensure a hermetic seal between the lid body and the closing plate 13.

The pivot hinge 20 comprises a first hinge part 21 that is secured to the box body 2 and a second hinge part 22 that is secured to the lid body. The first hinge part 21 is an elongated element that is suitable to insert it into the lumen 9. When the first hinge part 21 is inserted into the lumen a portion of the first hinge part 21 projects from the lumen that includes a bore 24 for receiving a pin of the hinge.

The second hinge part 22 is provided with a matching hinge pin 26 that is inserted into the bore 24. The first hinge part 21 includes a protrusion 25 that engages in a hole in the impact wall 58 of the collapsible projection 8. Thus, when the first part 21 is inserted into the lumen 9, the protrusion 25 snaps into the hole and thus secures the first part 21 from being released from the lumen 9. Thus, the first hinge part 21 is connected to the box body 2 by a snap lock.

The second hinge part 22 is provided with a resilient lip 27 and with a latch 28 at the free end of the resilient lip 27. The resilient lip 27 is shaped and sized such that its can be inserted into the lumen 19 of the collapsible projection 18 of the lid 3. The lumen 19 is open at both ends so the resilient lip 27 can be inserted into the lumen from one side with the latch 28 projecting from the opposite opening at the other side, with the latch preventing the second hinge part 22 to be pulled out of the lumen 19. Thus, the second hinge part 22 is connected to the lid body by a snap lock.

The first hinge part 21 and the second hinge part 22 have a relatively slim body structure that does not completely fill the space in the respective lumen 9, 19, so that the respective collapsible projections 8, 18 can still be compressed or collapse to a large extent upon impact, i.e. as if the lumen 9,19 was not filled with any obstructing object.

The side of the rim 11 at the hinge 20 is on its outer side provided one or more outwardly projecting teeth 46 that are configured to engage a corresponding recess 48 in the sidewall 15 of the lid 3 at the hinge 20 when the lid 3 is in the closed position. The one or more teeth 46 disengage from the lid 3 when the lid 3 is pivoted to a somewhat open position. The engagement between the one or more teeth 46 and the recess 48 in the lid 3 when the latter is in its closed position enhances the capacity of the lid 3 to resist being forcefully disengaged from the box body 2. The teeth 46 are integrally molded with the box body 2.

At the opposite side of the hinge 20, the box body 2 is provided with an H-shaped bracket 31. The H-shaped bracket 31 comprises two legs that are interconnected by a transverse member 36. The two legs are spaced to match the spacing between the lumen 9 on the corresponding sidewall 5 of the box body 2. The major portion of the legs is inserted into the lumen 9 with a projection 39 on the legs engaging a hole in the impact wall 59, so that the legs of the H-shaped bracket 31 are secured to the box body 2 by a snap lock connection.

A tongue 32 projects from each of the lumen 9 when the H-shaped bracket 31 is applied to the sidewall 5. The tongues 32 are shaped and sized and positioned such as to be tightly received inside a respective lumen 19 in the two collapsible projections 18 at the corresponding short side 15 of the lid body. Thus, the lid 3 is connected to the box body 2 via the tongues 32, thereby enhancing the rigidity and stability of the box and lid construction.

The transverse member 36 of the H-shaped bracket 31 is provided with two hooks 37 that serve to suspend the clasp 30. The legs of the H-bracket 31 are provided with downwardly projecting slim tongues 51 that serve to anchor the handle 35. Hereto, the slim tongues 51 are inserted into loops at the free ends of the handle 35. The handle extends into the lumen 9 via an opening 38 in the respective projection walls 59 that gives access to the lumen 9, alternatively, the opening 38 is provided at transition between the projection wall 59 and the impact wall 58. By inserting the slim tongues 51 that are securely located inside the lumen 9 into the loops of the handle 35 the handle 35 is robustly anchored in the box body 2.

In an embodiment (not shown) the tongues 32 are provided on two separate legs that are not interconnected i.e. not part of an H-shaped bracket.

At the opposite side of the hinge 20 the box body 2 is provided a clasp 30 that is pivotally suspended from sidewall 5 by a hinge 34. The clasp 30 is substantially L-shaped and can pivotally move from an open position where it does not engage the lid 3 to a closed position where it engages the lid 3. Hereto, the latter is preferably provided with a recess for receiving the clasp 30. The clasp 30 is provided at least one integrally molded pivot shaft 57 and with integral reinforcement ribs 59. The integrally molded pivot shaft 57 engages the hooks 37 of the H-shaped bracket 31.

The clasp 30 is a molded item of a third thermal plastic material.

The first thermoplastic material is in an embodiment a technical thermoplastic in the group of polypropylene or polyethylene. In an embodiment the thermoplastic material is provided with additives for extended temperature range, for UV protection, for electrostatic discharge protection and/or for flammability performance.

The second thermoplastic material is in an embodiment polyamide, preferably PA6 (Nylon you more preferable), with fiber reinforcement, such as e.g. glass fiber.

The third thermoplastic material is in an embodiment polyamide, preferably PA6 (Nylon) even more preferable with fiber reinforcing, such as glass fiber or with a softener.

For cross stacking of the ammunition boxes 1 it may be advantageous that the length to width relation of the ammunition box 1 is approximately 2:1.

The aim is to obtain a resilient ammunition box and lid construction that is capable of absorb impacts by being flexible and a rigid hinge construction, a rigid H-bracket, a rigid clasp and a rigid Lid-Insert being rigid enough to receive the impact without breaking and still capable of deforming slightly.

The present disclosure has been described in conjunction with various embodiments herein. However, other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. The reference signs used in the claims shall not be construed as limiting the scope.

The invention claimed is:

1. An ammunition box comprising:

a molded box body of thermoplastic material with an open top, wherein the thermoplastic material is Polypropylene or Polyethylene, the molded box body having four side walls, two of the four side walls being generally parallel to opposing side walls, a fixed substantially rectangular bottom wall connecting all four side walls at a bottom of the molded box body, the fixed bottom wall being generally perpendicular to the four side walls, said four side walls being connected to one another to form four corners of said molded box body that extend from said bottom of the molded box body to said open top, said molded box body defining a generally rectangular storage space for ammunition on the inside of said four side walls and the fixed bottom wall, and an integrally molded, hollow and collapsible projection provided on the outer side of said molded box body at or near each of said four corners, wherein said projection has an elongated hollow shape that defines a lumen extending substantially at a right angle from said fixed bottom wall, wherein said projection comprises two spaced projection walls that each project from said four side walls, said two spaced projection walls are connected by an impact wall that is spaced from a side wall by said two spaced projection walls, said impact wall together with said two spaced projection walls and a portion of a side wall defining said lumen, wherein said two spaced projection walls project from said four side walls at a near right angle, but not at an exact right angle, wherein said impact wall is a substantially planar wall that is substantially parallel with one of said side walls, with a transition between said impact wall and said two spaced projection walls being a round transition.

2. The ammunition box according to claim 1, wherein a peripheral portion of said four side walls closest to said open top forms an upright rim that surrounds a substantially rectangular opening to said rectangular storage space.

3. The ammunition box according to claim 2, wherein said integrally molded, hollow and collapsible projection is elongated and extends longitudinally from the transition between the portion of the four side walls that forms the upright rim and the remainder of said four side walls towards said fixed bottom wall, preferably terminating before the longitudinal extend reaches said fixed bottom wall.

4. The ammunition box according to claim 1, further comprising a flat generally rectangular molded lid of thermoplastic material with a shape and size suitable to close said open top, said lid being openable or releasably attached to the molded box body to selectively close and open said open top.

5. The ammunition box according to claim 4, wherein said lid comprises:

four lid side walls, two of the lid side walls being generally parallel to opposing lid side walls, a fixed substantially rectangular top wall connecting all four lid side walls at the top of the lid.

6. The ammunition box according to claim 5, wherein said lid sidewalls are connected at four corners of said lid, and each of said corners being provided with an integrally molded hollow and collapsible lid projection.

7. The ammunition box according to claim 6 wherein said integrally molded hollow and collapsible lid projections form an extension of said hollow and collapsible projections of the molded box body when said lid closes said open top.

8. An ammunition box comprising:

a substantially rectangular box with a molded box body of a first thermoplastic material, said molded box body defining a rectangular storage space for ammunition, said rectangular storage space opens to an open side of said molded box body, a molded rectangular lid of a first thermoplastic material configured to selectively close and open said open side of the molded box body, a peripheral area of said molded box body adjacent said open side being formed as a rim surrounding an opening to said storage space, said lid being shaped and sized to fit snugly around said rim with said rim being received inside said lid when said lid is in a closed position, said lid being provided on one of its outer sides with two spaced integrally molded hollow projections that each define a lumen opening towards the side of the lid that faces said opening when the lid closes the open side of the molded box body, an outer side of said molded box body being provided with two spaced tongues, said tongues having a main extend that is parallel with said rim and said tongues being marginally spaced from said rim, the spacing between said tongues corresponding to the spacing between said lumen and said tongues being received in said lumen when said lid is in its closed position, wherein an outer side of said molded box body is provided with two integrally molded hollow projections that each define a lumen that opens towards the open side of the molded box body, said tongues being formed by two elongated bodies, one of said two elongated bodies being inserted in each of said lumen with said tongue protruding from the lumen, wherein said two elongated bodies are part of an H-shaped bracket wherein said two elongated bodies are connected by a transverse member with the spacing between the two elongated bodies corresponding to the spacing between said lumen in the two integrally molded hollow projections.

9. The ammunition box according to claim 8, wherein said two elongated bodies are secured to the molded box body by a snap fit connection.

10. The ammunition box according to claim 8, wherein said transverse member is provided with a portion of a pivot hinge for a clasp, said clasp being pivotally suspended from said ammunition box and said clasp being configured to engage said lid in one pivotal position for locking said lid and being configured to disengage said lid in another pivotal position.

11. An ammunition box comprising:

a substantially rectangular box with a molded box body of a first thermoplastic material, said molded box body defining a rectangular storage space for ammunition, said rectangular storage space opens to one side of said molded box body, the one side of the molded box body forming an opening to the storage space, a molded rectangular lid of a first thermoplastic material configured to selectively close and open said opening, a pivot hinge pivotally connecting said lid to said molded box body, said pivot hinge comprising a first part attached to said molded box body and a second part attached to said lid, said first part and said second part being molded parts of a second thermoplastic material different from said first thermoplastic material, said first part defines a hinge pin and said second part defines a bore wherein said hinge pin is pivotally received or said second part defines a hinge pin and said first part defines a bore wherein said hinge pin is pivotally received wherein said molded rectangular lid is provided on an outer side with an integrally molded hollow projection that defines a lumen opening towards a side of the lid that faces said opening when the lid is in its closed position, said lumen being configured to receive a portion of said second part.

12. The ammunition box according to claim 11, wherein said first part is secured to said molded box body by a snap fit connection.

13. The ammunition box according to claim 11, wherein said second part is secured to said lid by a snap fit connection.

14. The ammunition box according to claim 11, wherein said molded box body is provided on its outer side with an integrally molded hollow projection that defines a lumen opening towards a side of the molded box body with the opening, said lumen being configured to receive a portion of said first part.

15. The ammunition box according to claim 11, wherein said first thermoplastic material is Polypropylene or Polyethylene, preferably with additives for extended temperature range and/or for UV protection and/or for electro static discharge protection and/or for flammability performance.

16. The ammunition box according to claim 11, wherein said second thermoplastic material is polyamide, preferably PA6 (Nylon), even more preferably with fiber reinforcement such as for example glass fiber reinforcement.

17. An ammunition box comprising:

a molded box body of thermoplastic material with an open top, wherein the thermoplastic material is Polypropylene or Polyethylene, the molded box body having four side walls, two of the four side walls being generally parallel to opposing side walls, a fixed substantially rectangular bottom wall connecting all four side walls at the bottom of the molded box body, the fixed bottom wall being generally perpendicular to the four side walls, said four side walls being connected to one another to form four corners of said molded box body that extend from said bottom of the molded box body to an open top, said molded box body defining a generally rectangular storage space for ammunition on the inside of said side walls and fixed bottom wall, and an integrally molded, hollow and collapsible projection provided on the outer side of said molded box body at or near each of said four corners, wherein a peripheral portion of said four side walls closest to said open top forms an upright rim that surrounds a substantially rectangular opening to said rectangular storage space, wherein a transition between the portion of the four side walls that forms the upright rim and the remainder of said four side walls that extends from said transition to said fixed bottom wall coincides with a plane that is parallel with said bottom wall.

18. An ammunition box comprising:

a molded box body of thermoplastic material with an open top, wherein the thermoplastic material is Polypropylene or Polyethylene, the molded box body having four side walls, two of the four side walls being generally parallel to opposing side walls, a fixed substantially rectangular bottom wall connecting all four side walls at a bottom of the molded box body, the fixed bottom wall being generally perpendicular to the four side walls, said four side walls being connected to one another to form four corners of said molded box body that extend from said bottom of the molded box body to said open top, said molded box body defining a generally rectangular storage space for ammunition on the inside of said four side walls and the fixed bottom wall, and an integrally molded, hollow and collapsible projection provided on the outer side of said molded box body at or near each of said four corners, wherein a peripheral portion of said four side walls closest to said open top forms an upright rim that surrounds a substantially rectangular opening to said rectangular storage space, wherein said four side walls are provided with one or more outwardly directed projections at a transition between the portion of the four side walls that forms the rim and the remainder of said four side walls that extends from said transition to said fixed bottom wall.

* * * * *